US005658091A

United States Patent [19]

Goughnour et al.

[11] Patent Number: 5,658,091

[45] Date of Patent: Aug. 19, 1997

[54] APPARATUS FOR INSERTING PREFABRICATED VERTICAL DRAINS INTO THE EARTH

[75] Inventors: R. Robert Goughnour, Leesburg, Va.; C. Russell Joiner, Peachtree City, Ga.

[73] Assignee: Geotechnics America, Inc., Peactree City, Ga.

[21] Appl. No.: 593,738

[22] Filed: Jan. 29, 1996

[51] Int. Cl.[6] ..... E02D 3/10

[52] U.S. Cl. ..... 405/50; 405/232; 405/249; 405/303; 175/270; 175/162; 175/49; 175/149; 175/152

[58] Field of Search ..... 405/232, 50, 303, 405/249, 228, 245, 246; 175/19, 122, 162, 170, 220; 173/162.1, 149, 152, 49, 142, 146

[56] References Cited

U.S. PATENT DOCUMENTS

| | | | |
|---|---|---|---|
| 4,755,080 | 7/1988 | Correver et al. | 405/50 |
| 5,117,925 | 6/1992 | White | 405/232 X |
| 5,213,449 | 5/1993 | Morris | 405/249 |
| 5,281,775 | 1/1994 | Gremillion | 73/49 X |
| 5,439,326 | 8/1995 | Goughnour et al. | 405/303 |
| 5,584,603 | 12/1996 | Correver | 405/50 |

*Primary Examiner*—Tamara L. Graysay
*Assistant Examiner*—Frederick Choman
*Attorney, Agent, or Firm*—Carothers & Carothers

[57] ABSTRACT

Apparatus for inserting prefabricated drain members downwardly into underlying earth which includes a vertically extending mast that supports an elongated earth penetrating mandrel. The mandrel is adapted to receive a prefabricated drain member for movement with the mandrel down into the earth to insert drain members. A drive is mounted on the mast for driving the mandrel into and out of the underlying earth and the drive includes a rotary drive gear that engages the mandrel and a motor for driving the gear. A vibrator is mounted on the upper end of the mandrel for imparting vibrations to assist in its penetration into the earth. A flexible torsion drive coupler couples the motor to the drive gear for driving the drive gear and for also isolating the motor and the mast from vibrations imparted to the mandrel by the vibrator.

12 Claims, 4 Drawing Sheets

APPARATUS FOR INSERTING PREFABRICATED VERTICAL DRAINS INTO THE EARTH

BACKGROUND OF THE INVENTION

This invention relates generally to apparatus for inserting prefabricated vertical (PV) drains (sometimes referred to as wick or band drains) into the earth, and more specifically to an improved apparatus for inserting PV drains into dense or hard soil layers.

One well known technique for preparing soil that has a high moisture content, such as wet clay, for example, is to drive into the soil a drainage element that penetrates deep into the soil with the top end of the drainage element maintained above the surface of the soil. The PV drain is formed of any suitable material which is water permeable, or perforated to be water permeable, so that the water in the soil can penetrate the walls of the drain and flow upwardly therein to the surface of the soil as a result of water pressures in the soil beneath the surface. It is common practice in such situations to increase these inherent water pressures in the soil by placing a layer of earth on top of the wet soil so that the weight thereof will assist in forcing the water into and upwardly through the PV drains, where the water can be readily disbursed.

The PV drain is generally elongated and flexible and it is carried into the ground by utilizing a rigid insertion tube or mandrel formed of a suitable metal. This insertion tube, together with the drain, is driven downwardly into the earth to the desired depth and then the insertion tube is pulled out of the soil thereby leaving the PV drain. The drains are inserted at regular predetermined intervals in the earth, depending upon the soil conditions and moisture content.

This rigid insertion tube or mandrel which carries the elongated flexible PV drain therein, is adapted for vertical movement within a mast. The insertion tube is generally driven downwardly into the earth and retracted therefrom with a drive mechanism. This drive mechanism is preferably positioned at the bottom or lower end of the mast, and by way of example, may consist of a pair of friction rollers, or even more preferably, a gear drive mechanism which is positioned at the lower end of the mast as disclosed in U.S. Pat. No. 5,213,449 for APPARATUS FOR INSERTING WICK DRAINS INTO THE EARTH issued to Morris, which is incorporated herein by reference. Normally a vehicle is provided which supports the mast at its base and is further adapted to raise and lower the mast to and from vertical and to otherwise manipulate and transport the mast.

The present invention pertains to an improvement to the gear drive apparatus disclosed in the Morris patent. The Morris patent discloses a number of prior art devices for inserting wick drains into the earth. These include a vibratory driver that engages the top of the insertion tube or mandrel, hydraulic cylinders and cables that engage the tube at its upper end, chain drives that also engage the tube at its upper end, etc. It is also pointed out that it is known to utilize vibratory means in combination with cable or chain drives, commonly referred to as vibro/static machines.

In general most of these prior art arrangements engage and drive the insertion tube at its top end, requiring a relatively heavy mast and boom arrangement to support the insertion tube or mandrel and the drive mechanism. This not only increases the weight of the apparatus, but also increases the cost of fabrication as well as the maintenance.

This prior art friction roller arrangement overcomes the problem of engaging the insertion tube at its upper end, but suffers from the tendency of the friction rollers to slip when the mandrel or insertion tube is covered with wet, slippery soil material which adheres to the mandrel. The Morris patent overcomes this problem by utilizing a drive gear to positively engage a flange or fin which is attached to and coextends with the mandrel. This flange contains rack gear mesh openings spaced along its length, which the teeth of the drive gear engage. This mechanism is similar to a rack and pinion arrangement.

From a geotechnical standpoint, it is preferable to install vertical drains without the use of vibration, since such vibration can remold the soil in close proximity with the mandrel, resulting in loss of strength and decrease in permeability. Lower permeability of the soil in this region impedes the flow of water into the drain, requiring longer surcharge periods. However, vibration greatly enhances the ability of the apparatus to penetrate, and it is often necessary to penetrate through dense or hard soil layers to reach an underlying soft soil layer. These layers are often so hard that it is not possible to penetrate them without the use of a vibratory mechanism. The combination machines (vibro/static machines) are very useful in these cases, since the vibration can be turned on only during penetration through the hard layers. Further, vibrating the mandrel induces very high stresses, and fatigue of the mandrel material becomes a problem.

The present invention discloses means to add vibratory capability to the gear drive apparatus disclosed in the Morris patent. The present invention permits the apparatus of the type disclosed in the Morris patent to operate without vibration to the supporting equipment and the vibrating shock imparted to the mandrel is isolated from the motor and planetary gear box and the remainder of the machine. This permits application of vibrations to the mandrel either intermittently or constantly as required and greatly extends the usefulness and life of the machine.

SUMMARY OF THE INVENTION

The apparatus of the present invention for inserting drain members downwardly into the underlying earth comprises a mast that is adapted to be arranged with a generally vertical extent above the underlying earth in combination with an elongated earth penetrating tube or mandrel which is carried by the mast for vertical movement relative to the mast. The mandrel is adapted for receiving a drain member for movement with the mandrel to thereby insert the drain member in underlying soil.

A drive is mounted on the mast for driving the mandrel into and out of the underlying earth. This drive preferably includes a rotary drive gear of the type disclosed in Morris for engaging the mandrel and also a motor for rotating or driving the drive gear. To this point, the apparatus parallels the prior art.

A vibrator is mounted on the mandrel adjacent its upper end for imparting vibrations to the mandrel to assist in penetration of the mandrel into the underlying earth. In order to isolate the motor, which generally includes a speed reduction gear drive, from vibrations imparted to the mandrel by the vibrator, a flexible torsion drive coupler is utilized to couple the motor to the drive gear in accordance with the teachings of the present invention.

The flexible torsion drive coupler may include at least one elastomer torsion ring. In fact, in order to provide sufficient torsion load capabilities, two or more such elastomer torsion rings may be ganged together in a side by side relationship.

The elastomer torsion rings include inner and outer coaxial support sleeves which are bonded to the elastomer rings respectively. The flexible torsion drive further includes inner and outer coaxial drive sleeves which are respectively and detachably secured to the inner and outer support sleeves for driving engagement therebetween. A suitable support bearing, such as a sleeve bearing or bushing, is disposed between these drive sleeves for permitting supported relative axial rotational slip between the sleeves which is due to the torsional distortion of the elastomer torsion rings caused by vibrations imparted to the mandrel.

Generally the motor is connected to rotatably drive the inner drive sleeve and the drive gear for driving the mandrel vertically up and down is rotatably driven by the outer drive sleeve. In addition, the drive gear is coaxially received by the outer drive sleeve. This combination provides an extremely strong gear drive mechanism for vertically driving the mandrel while permitting isolation of vibrations imparted to the mandrel by the vibrator from the motor and its associated gear drive.

Any number of vibrator types may be utilized for imparting vertical vibrations to the mandrel. One such commonly known and acceptable vibrator has synchronized counter driven eccentric weights which are utilized for imparting vertical vibrations to the mandrel. The vibrator may of course be turned on and off as required.

BRIEF DESCRIPTION OF THE DRAWINGS

Other objects and advantages appear in the following description and claims.

The accompanying drawings show, for purpose of exemplification, without limiting the invention or claims thereto, certain practical embodiments illustrating the principals of this invention, wherein:

DESCRIPTION OF THE PREFERRED EMBODIMENT

Figure 1:
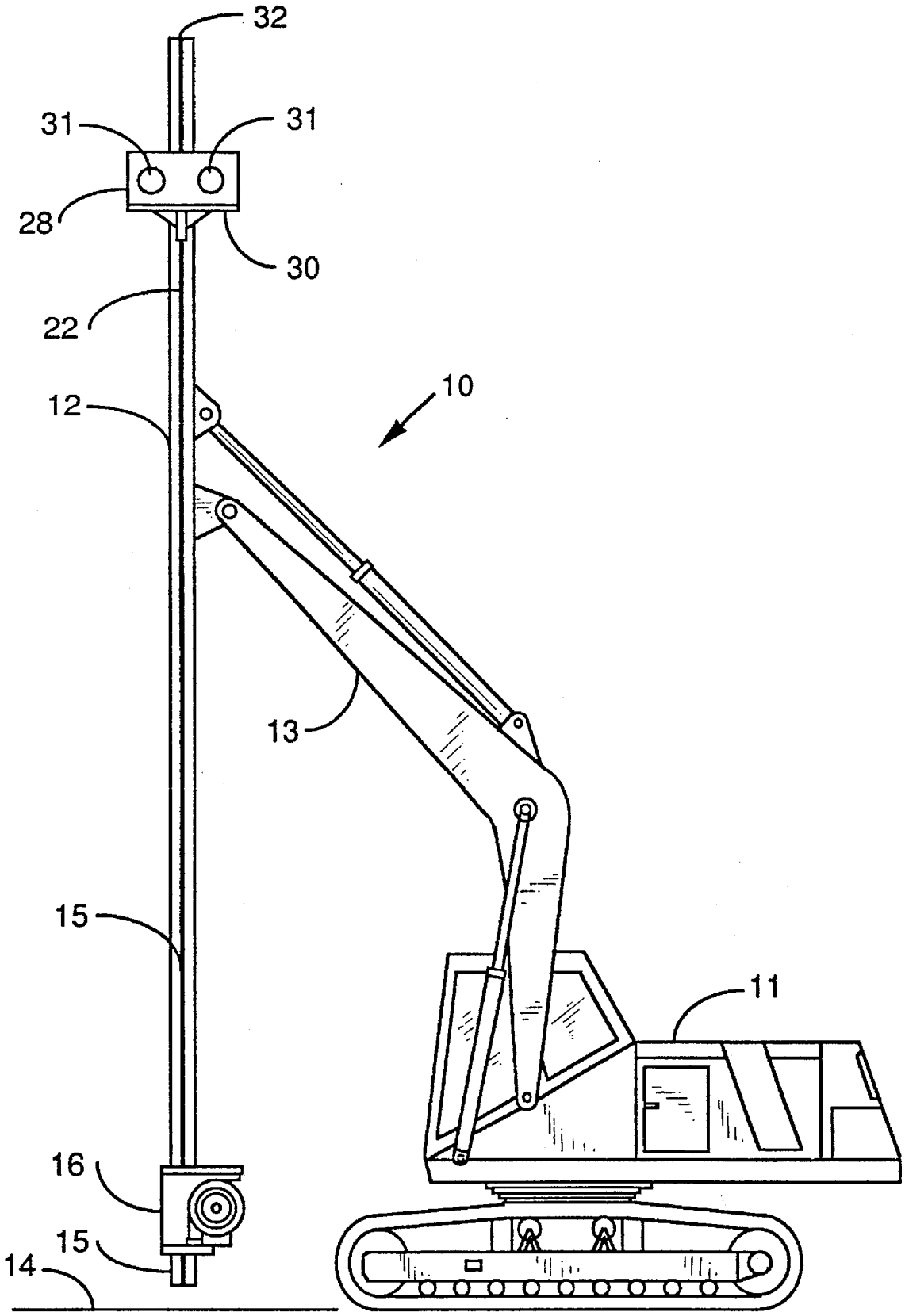
FIG. 1 is a general view in vertical side elevation illustrating the apparatus of the present invention.
Figure 2:
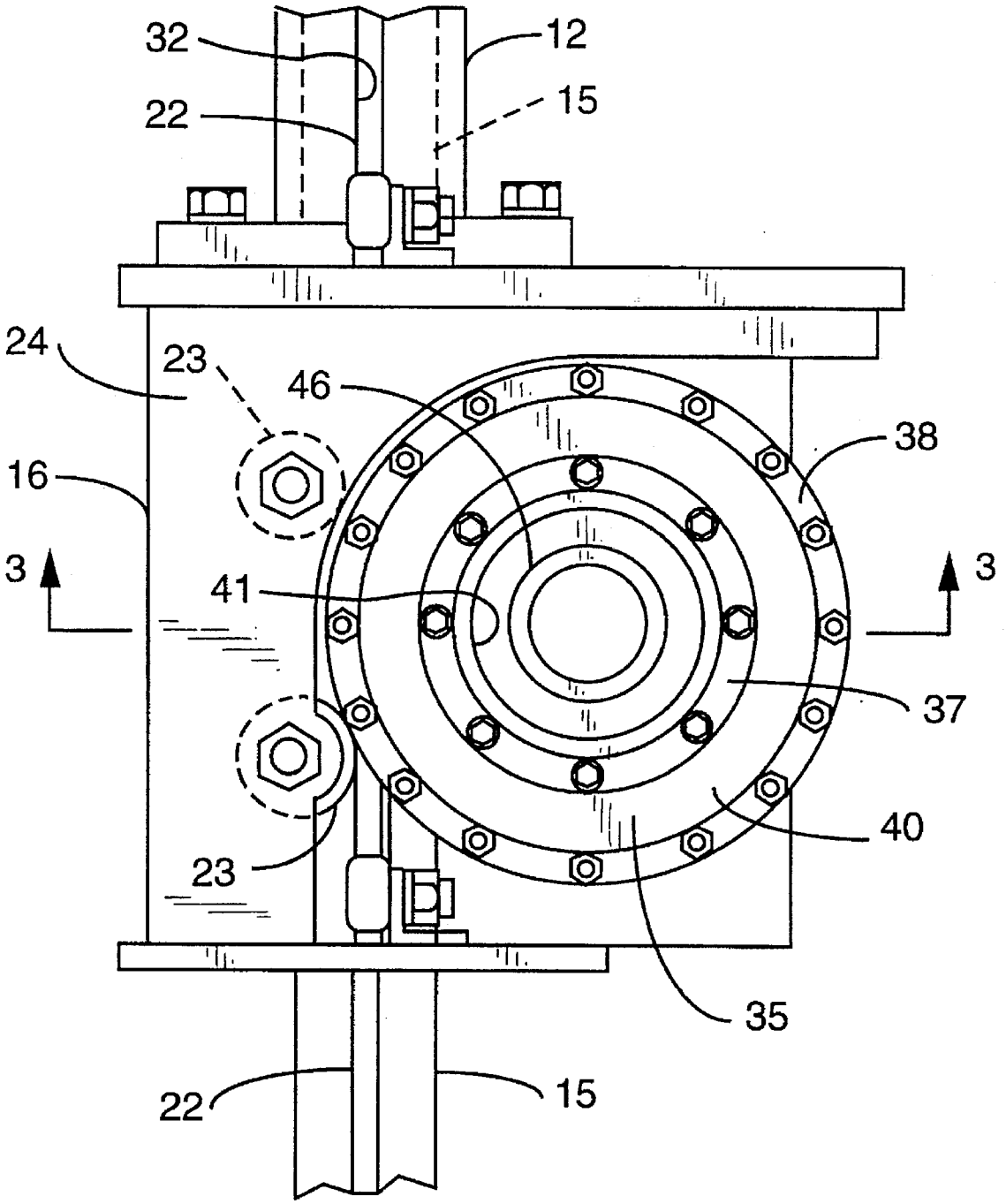
FIG. 2 is an enlarged detailed view illustrating the mandrel drive mechanism and its associated flexible torsion drive coupler for the apparatus shown in FIG. 1.

Referring to the drawings, the drain inserting apparatus 10 of the present invention is supported by a motorized vehicle or tractor 11, which may be of any suitable conventional type, and supports and manipulates the mast 12 with hydraulically operated manipulating arms 13. The mast 12 may be manipulated by arm 13 such that it extends generally vertical above the underlying earth 14 as shown in FIG. 1.

An elongated earth penetrating mandrel 15 is carried within hollow tubular mast 12 for vertical movement relative to mast 12. Mandrel 15 is a hollow insertion tube which is adapted to receive a drain member therein for movement with the mandrel in order to insert the drain members into the underlying soil 14 in exactly the same manner as is described in Morris U.S. Pat. No. 5,213,449.

In similar fashion to the drive mechanism disclosed in Morris, the drive mechanism 16 of the present invention is mounted on mast 12, adjacent the lower end thereof, for driving mandrel 15 into and out of underlying earth 14. This drive includes a rotary drive gear 20 which engages the aligned rack gear openings 21 of mandrel fin or flange 22 in rack and pinion fashion to vertically drive mandrel 15 as described in detail in the Morris patent. The support rollers 23 are rotatably carried on the drive housing 24 to hold the flange 22 against drive gear 20.

Figure 3:
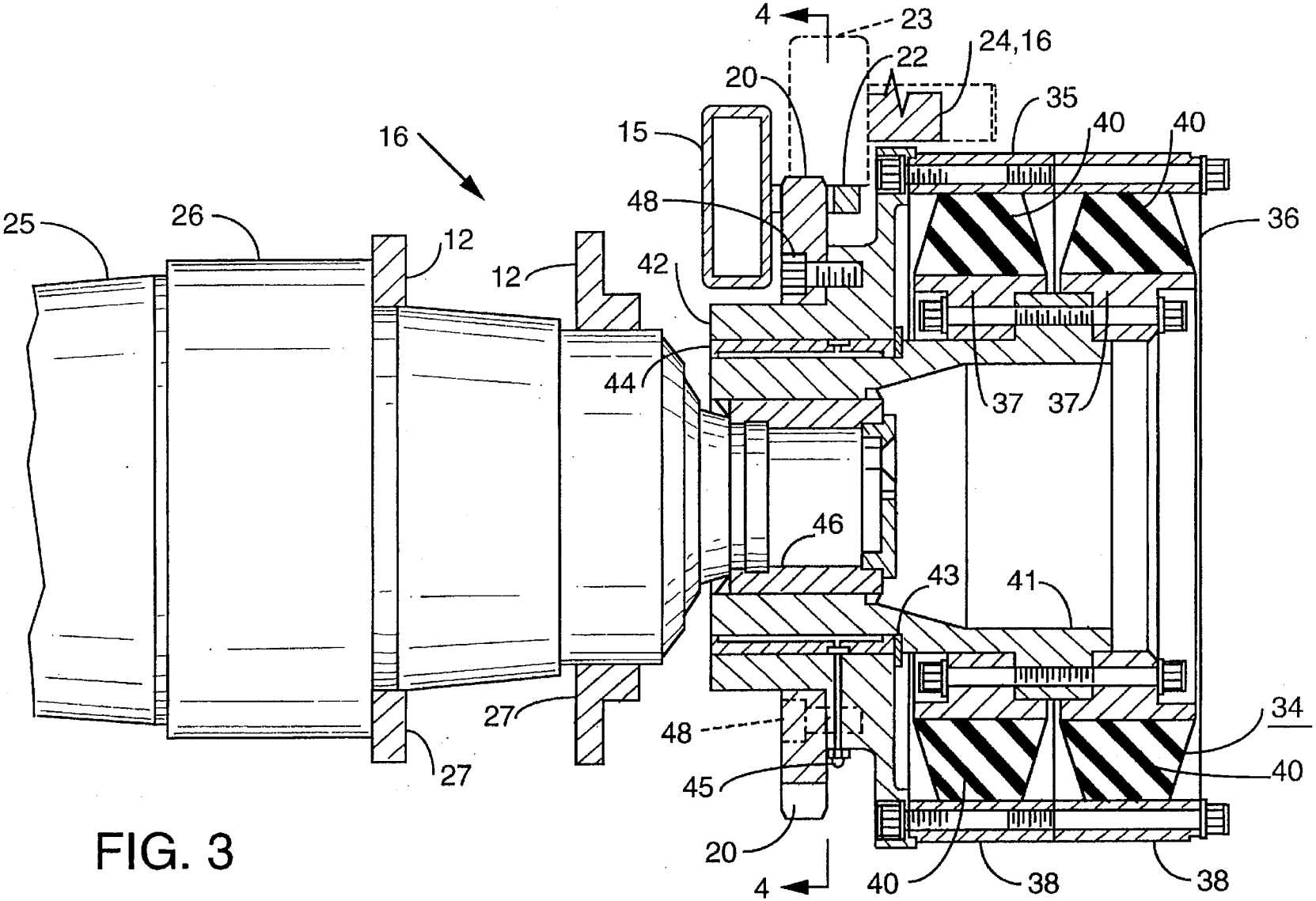
FIG. 3 is a bottom view in horizontal cross section and rotated 90° of the drive mechanism illustrated in FIG. 2 as seen along section line 3—3.
Figure 4:
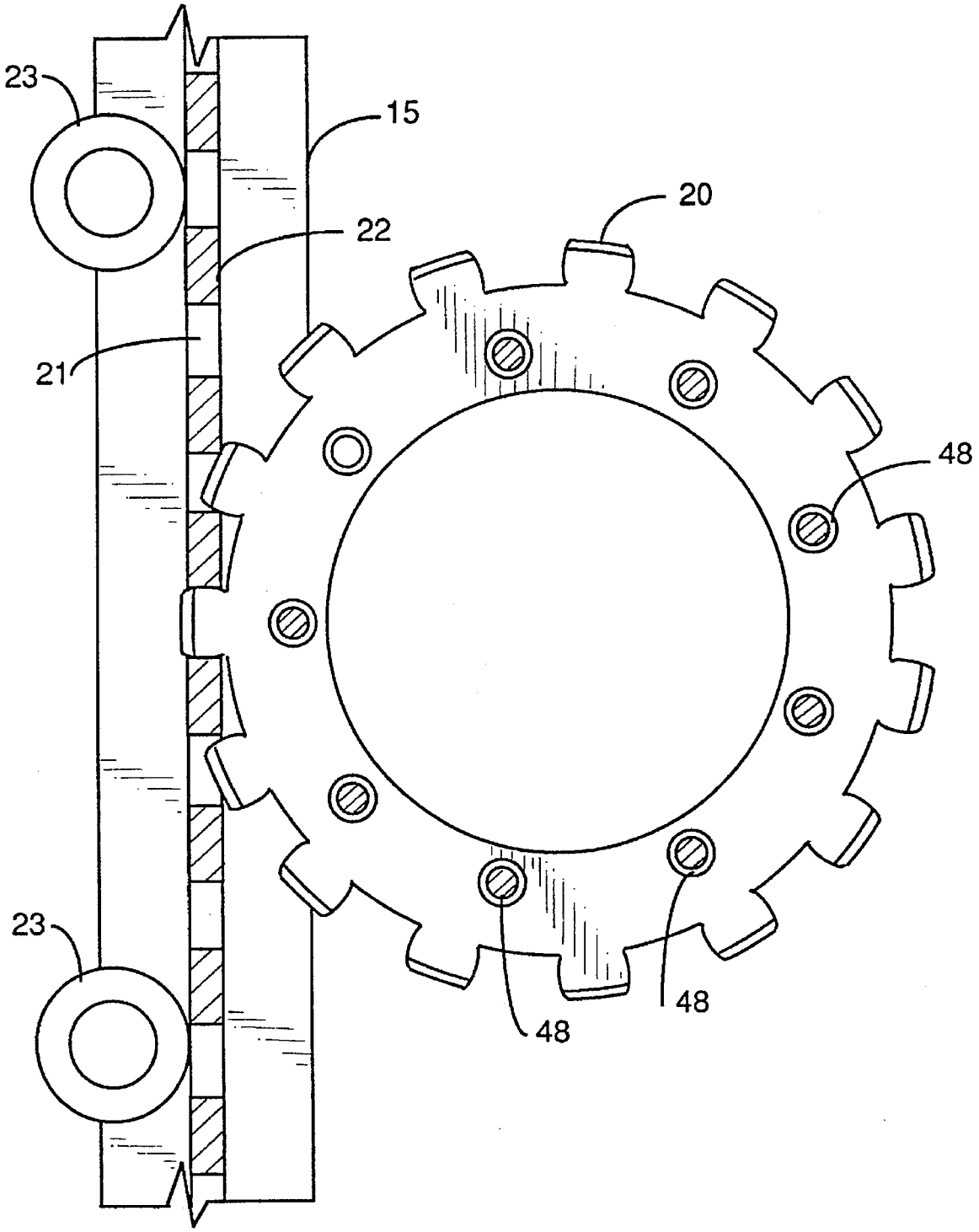
FIG. 4 is a view is side elevation of the drive mechanism shown in FIG. 2, as seen along section line 4—4 of FIG. 3, with major potions thereof removed to disclose the drive gear for vertically driving the mandrel.

The drive 16 includes a suitable hydraulic reversible drive motor 25 and a speed reduction planetary gear box 26 of the type described in the Morris patent. This is best illustrated in FIG. 3. The motor and gear box are mounted to the rear portion of the drive box 16 as viewed in FIG. 1 and as shown in detail in FIG. 3, and is supported and mounted directly to mast 12 by mount 27. Gear box housing 24 and drive 16 in general are also supported on the lower end of mast 12.

With particular reference to FIG. 1 again, vibrator 28 is mounted on flange or fin 22 of mandrel 15 adjacent the upper end of mandrel 15. Vibrator 28 is a commercially available vibrator utilizing synchronized counter driven eccentric weights 31 to impart vertical vibrations to mandrel 15. Vibrator 28 is rigidly secured to shelf 30 which in turn is directly attached as by welding to mandrel 15 via the extending flange 22, which is exposed through the side channel opening 32 of tubular mast 12.

The drive box 16 at the lower end of mast 12 is modified in accordance with the teachings of the present invention to isolate vibration of the mandrel 15 from the mast 12 and the carrier vehicle 11. The vibration damping component is comprised of a flexible torsion drive coupler 34 which couples drive gear box 26 to drive gear 20 to in turn vertically drive mandrel 15 and yet isolate motor 25 and gear box 26, and for that matter other associated parts of the apparatus 10, from vibration imparted to mandrel 15 by vibrator 28.

Flexible torsion drive coupler 34, as best illustrated in FIG. 3, consists of a ganged side by side pair of elastomer torsion rings 35 and 36. These torsion couplers are commercially available on the market and are manufactured by Lord Industrial Products.

The elastomer torsion rings 35 and 36 include inner and outer coaxial support sleeves 37 and 38 respectively which are bonded to the rubber elastomer rings 40. The drive further includes inner and outer coaxial drive sleeves 41 and 42 which are detachably secured respectively to inner and outer support sleeves 37 and 38 by bolts as indicated.

A suitable bearing in the form of a brass bushing 44 is disposed between drive sleeves 41 and 42 to support them for relative axial rotational slip therebetween due to torsional distortion of the elastomer torsion rings 40. Bearing 44 is readily lubricated by grease fitting 45. Brass thrust washer 43 maintains the axial position of the assembly.

The output shaft of speed reduction planetary gear box 26 directly drives splined sleeve 46, which in turn is directly welded to inner drive sleeve 41 for rotary driving engagement.

Drive gear 20 is coaxially secured to outer drive sleeve 42 via conventional bolts 48.

Modifications to the drive are within the spirit of the present invention and the appended claims.

For example, while the drive mechanism preferably utilized is the drive gear 20, the drive mechanism of the present invention may still be utilized effectively in combination with other mandrel drive mechanisms of the prior art as previously mentioned, such as pinch rollers or even drive chains or cables which are secured to the upper end of a mandrel which are driven by a rotary drive member.

Also, when prefabricated vertical drains must be inserted downwardly into the earth at extra ordinary lengths by a mechanism such as disclosed in U.S. Pat. No. 5,439,326, then it is not practical to mount the vibrator 28 to the upper end of the extra long mandrel as the tall mast structure could not adequately support the added weight and the vibration impacts on its upper end. Accordingly then with the mechanism as shown in Goughnour et al. U.S. Pat. No. 5,439,326, the vibrator 28 cannot be initially secured to the mandrel 15 at its upper end and instead will be intermediately and adjustably positioned on and secured to the mandrel flange 15 at a lower position intermediate the upper and lower ends of the mandrel. Then, as the mandrel is driven downwardly into the earth, the vibrator together with its shelf and mount 30 is temporarily detached and slid upwardly on mandrel 15 to a higher position and the procedure is repeated.

In this manner, the vibrator 28 is periodically repositioned upwardly on the mandrel 15 as it is being driven downwardly into the earth.

We claim:

1. Apparatus for inserting drain members downwardly into underlying earth, said apparatus comprising:

a mast adapted to be arranged with a generally vertical extent above underlying earth;

an elongated earth penetrating mandrel carried by said mast for vertical movement, said mandrel adapted for receiving a drain member for movement therewith to insert drain members in underlying earth;

a drive mounted on said mast for driving said mandrel into and out of underlying earth, said drive including a rotary drive gear and a motor for rotatably driving said drive gear;

a vibrator mounted on said mandrel for imparting vibrations thereto to assist in penetration of said mandrel into underlying earth; and a flexible torsion drive coupler coupling said motor to said rotary drive gear for driving said drive gear and isolating said motor and mast from vibrations imparted to said mandrel by said vibrator.

2. The apparatus of claim 1, said mandrel having an upper and a lower end and said vibrator mounted adjacent the upper end of said mandrel.

3. The apparatus of claim 2, said mast having an upper and a lower end and said rotary drive gear comprising a drive gear positioned adjacent the lower end of said mast.

4. The apparatus of claim 3, said motor including a speed reduction gear drive.

5. The apparatus of claim 4, said flexible torsion drive coupler including at least one elastomer torsion ring.

6. The apparatus of claim 5 including a vehicle supporting said mast for transport thereof.

7. The apparatus of claim 5, said flexible torsion drive coupler including a ganged side by side pair of said elastomer torsion rings.

8. The apparatus of claim 5, said elastomer torsion ring including inner and outer coaxial support sleeves bonded thereto, said flexible torsion drive coupler further including inner and outer coaxial drive sleeves respectively and detachably secured to said inner and outer support sleeves for driving engagement therebetween, and a bearing disposed between said drive sleeves for permitting supported relative axial rotational slip therebetween due to torsional distortion of said elastomer torsion ring.

9. The apparatus of claim 8, said motor connected to rotatably drive said inner drive sleeve and said drive gear connected to be rotatably driven by said outer drive sleeve.

10. The apparatus of claim 9, said flexible torsion drive including a ganged side by side pair of said elastomer torsion rings.

11. The apparatus of claim 9, said drive gear coaxially secured to said outer drive sleeve.

12. The apparatus of claim 9, said vibrator including synchronized counter driven eccentric weights for imparting vertical vibrations to said mandrel.

* * * * *